United States Patent [19]

Cziesla et al.

[11] 4,219,374

[45] Aug. 26, 1980

[54] MONOPROPELLANT COMPOSITION

[75] Inventors: Manfred J. Cziesla; Kurt F. Mueller, both of Oxon Hill, Md.

[73] Assignee: The United States of America as represented by the Secretary of the Navy, Washington, D.C.

[21] Appl. No.: 678,484

[22] Filed: Oct. 23, 1967

[51] Int. Cl.[3] ..... C06B 29/22

[52] U.S. Cl. ..... 149/75; 149/76

[58] Field of Search ..... 149/75, 109, 76

[56] References Cited

U.S. PATENT DOCUMENTS

| | | | |
|---|---|---|---|
| 3,125,852 | 3/1964 | Blackwell et al. | 149/76 X |
| 3,344,004 | 9/1967 | Desmarais | 149/44 X |

*Primary Examiner*—Stephen J. Lechert, Jr.

*Attorney, Agent, or Firm*—R. S. Sciascia; A. L. Branning

[57] ABSTRACT

A liquid monopropellant composition comprising the water solution of hydroxylammonium perchlorate and a compatible water soluble or water dispersible fuel.

9 Claims, No Drawings

MONOPROPELLANT COMPOSITION

BACKGROUND OF THE INVENTION

This invention relates generally to a novel liquid monopropellant composition and more particularly to a novel liquid monopropellant composition especially useful for underwater propulsion, gas generators and other applications.

The simplest type of liquid propellant system is the liquid monopropellant engine which basically comprises either a fuel dissolved in an oxidizer (or vice versa), or a liquid solution in which all of the oxidizer and fuel necessary for combustion is combined in a single molecule. This type of propellant is generally preferred over other compositions because of its high degree of thrust control and because of the simplicity of the feed system necessary to feed the composition to the combustion chamber of the reaction motor; there being required only a single pump, a single storage tank and a single feed line. Presently, however, the state of the art liquid monopropellants are generally inadequate for such military applications as torpedo propulsion and underwater gas generators since a greater portion of their combustion products are not water soluble. Insoluble products are deleterious for military operations because they are the prime cause of surface wake which facilitates enemy detection of the underwater vehicle. The wake also tends to interfer with both the noise-sensitive sonar homing device within the torpedo and with the detection devices on the launching submarine.

Another problem with conventional liquid monopropellant compositions is that in view of the substantial increase in the performance of modern ships and submarines in recent years, conventional propellants are no longer adequate to meet the military demands for greater range, depth and speed which properties necessitate compositions having greater energetics than those presently available.

It is therefore desirable to obtain a liquid monopropellant which can generate a high percentage of water soluble combustion products yet which is characterized by high energetics capabilities.

SUMMARY OF THE INVENTION

It is therefore an object of this invention to provide a new liquid monopropellant which generates a high percentage of water soluble gases on combustion.

It is also an object of this invention to provide a liquid monopropellant having greater energetics than those previously available.

Finally, it is an object to provide a liquid monopropellant which is especially suited for underwater propulsion applications.

These and other objects are achieved herein by providing a water solution of an hydroxylammonium perchlorate oxidizer and a compatible water soluble or water dispersible fuel.

DETAILED DESCRIPTION OF THE PREFERRED EMBODIMENTS

The novel monopropellants of this invention are prepared by forming a water solution or emulsion of an hydroxylammonium perchlorate (HAP) oxidizer and a water soluble or water dispersible fuel wherein said oxidizer, fuel and water are present in the weight ratio of 1:9:10 to 16:1:2.

It is believed that water acts in the present composition as a desensitizing agent for the HAP oxidant and hence is the critical factor for permitting the use of HAP in the monopropellant environment. It is also believed that water provides the necessary cooling to control the flame temperature of the combustion reaction. For these purposes it is desirable to use water in an amount sufficient to provide a water to oxidizer ratio of 1:10 to 16:2 and more preferably from about 5% to about 100% based on the combined weight of the fuel and oxidant.

The quantity of fuel used in the composition is not critical and is dependent generally on the particular type selected and on the percentage of insoluble exhaust products which can be tolerated for a given application. The more closely the quantity of fuel and oxidant approximates the stoichiometric balance, the greater the percentage of water soluble exhaust products will be provided. In general, sufficient fuel should be present to provide the weight ratio of fuel to oxidant of from about 1:9 to about 16:1.

For the purposes of this invention, a large number of fuels are operable herein. For instance, operable fuels include the polyhydric alcohols such as glycerin, ethylene glycol, diethylene glycol, triethylene glycol, tetramethylene glycol, ethylene glycol monoethyl ether, propylene glycol, dipropylene glycol, dimethoxytetraethylene glycol, diethylene glycol monomethyl ether, the acetate of ethylene glycol monoethyl ether and the acetate of diethylene glycol monoethyl ether; ketones, for example, acetone and methyl butyl ketone; monohydric alcohols such as methanol, propanol, butanol, phenol and benzyl alcohol; ethers, such as dimethyl and diethyl ether, and dioxane; also the nitriles such as acetonitrile; the amides, such as formamide and acetamide; sulfoxides such as dimethylsulfoxide; sulfones such as dimethyl and diethyl sulfone, and the cyclic sulfones such as tetrahydrothiophene-1,1-dioxide; the amines and amino acids, such as ethyl amine, diethyl amine, ethanol amine, hydroxylamine, substituted hydroxylamines such as methyl and ethyl hydroxylamine and $\alpha$-amino propionic acid; sugars such as sucrose; water soluble polymers such as hydrolyzed polyvinylacetate, polyacrylic esters and polymethacrylic esters; and mixtures thereof.

Among the water dispersible fuels which may be used include No. 2 fuel oil, JP4 fuel, diesel fuel and commercial tall oils. When the water dispersible fuels are used, they must be dispersed in the water by the use of a suitable surfactant such as the alkaryl sulfonates, the long chain aliphatic sulphates and the like.

Many additives may be added to this composition to modify its properties without departing from the present invention. For example, various stabilizers may be included such as ethylenediaminetetracetic acid, the salts thereof and similar complexing agents.

The composition as here described will provide up to about 80% or more of water soluble combustion products in the form of water and hydrogen chloride thereby rendering the composition especially suited for underwater propulsion where minimum wake characteristics are required. Another advantage of a water soluble exhaust is that the range of the torpedo propelled by the present composition will not decrease substantially with increasing depth, as with conventional chemically propelled torpedoes. In the conventional torpedo, as depth increases, the surrounding water pressure increases and the insoluble exhaust gases tend to cause a severe retarding back pressure which reduces the velocity of any further escaping gases. This problem is significantly diminished where the exhaust gases are water soluble. Since the velocity of the combustion gases is relatively constant, the range of the torpedo also remains about constant regardless of depth.

The compositions of this invention are also characterized by the additional desirable properties of long storage stability, low shock sensitivity, nonflammability, noncorrosiveness, nontoxicity and may be prepared from relatively inexpensive materials. Another advantage is that the present composition has a higher energy content than conventional fuels as measured on either a weight or a volume basis.

Having generally described the invention the following examples are given for purposes of illustration.

Table I

| Example | Composition % | Weight | Isp | Flame Temp. °F. | % Vol. Conds'ble Exhaust Products | % Vol. $Co_2$ | % Vol. Other |
|---|---|---|---|---|---|---|---|
| 1 | 59.5 | HAP | 220.8 | 3660 | 77.7 | 16.8 | 5.5 |
| | 20.5 | glycerin | | | | | |
| | 20.0 | $H_2O$ | | | | | |
| 2 | 55.8 | HAP | 212.0 | 3130 | 79.7 | 15.2 | 5.1 |
| | 19.2 | glycerin | | | | | |
| | 25.0 | $H_2O$ | | | | | |
| 3 | 48.3 | HAP | 191.0 | 2581 | 83.2 | 12.6 | 4.2 |
| | 16.7 | glycerin | | | | | |
| | 35.0 | $H_2O$ | | | | | |
| 4 | 45.0 | HAP | 184 | 2162 | 68.1 | 16.5 | 15.4 |
| | 25.0 | glycerin | | | | | |
| | 30.0 | $H_2O$ | | | | | |
| 5 | 40.0 | HAP | 170 | 1678 | 73.1 | 14.8 | 12.1 |
| | 25.0 | glycerin | | | | | |
| | 35.0 | $H_2O$ | | | | | |
| 6 | 70.0 | HAP | 242.7 | 4553 | 70.3 | 20.8 | 9.0 |
| | 25.0 | glycerin | | | | | |
| | 5.0 | $H_2O$ | | | | | |
| 7 | 48.7 | HAP | 198.8 | 2754 | 84.0 | 11.8 | 4.2 |
| | 11.3 | Dioxane | | | | | |
| | 40.0 | $H_2O$ | | | | | |
| 8 | 53.53 | HAP | 208.7 | 3135 | 81.8 | 13.4 | 4.8 |
| | 9.18 | dioxane | | | | | |
| | 2.29 | benzyl-alcohol | | | | | |
| | 35.0 | $H_2O$ | | | | | |
| 9 | 73.45 | HAP | 232.8 | 4348 | 69.7 | 19.9 | 10.4 |
| | 11.55 | phenol | | | | | |
| | 15.0 | $H_2O$ | | | | | |
| Control | Otto Fuel II liquid monopropellant | | 207 | 2450 | 12.8 | 10.7 | 76.5 |

The stability of different monopropellant compositions of this invention were tested for decomposition at 60° C. and for periods of up to 65 days. The results are summarized below:

TABLE II

| Composition | Time (Days) | Decomposition |
|---|---|---|
| HAP + methanol + 25% $H_2O$ | 65 | none |
| HAP + glycerin + 25% $H_2O$ | 65 | none |
| HAP + dioxane + 25% $H_2O$ | 51 | none |
| HAP + diethylene glycol dimethyl ether + 25% $H_2O$ | 51 | none |
| HAP + tetraethylene glycol dimethyl ether + 25% $H_2O$ | 51 | none |

The sensitivity of different monopropellant compositions of this invention were measured by standard tests and the results summarized below. The Card gap test (JANAF Test No. 1) is performed by filling a Teflon coated steel pipe 1" in diameter and 3" high with the monopropellant. Cellulose acetate cards are stacked at the bottom of the plate below which a tetryl pallete is fitted with a suitable igniting device. The tetryl is ignited and the results are recorded as the number of cellulose acetate cards necessary to prevent ignition of the monopropellant.

The impact sensitivity test consists of dropping a 2 Kgm weight onto a small sample of the monopropellant. The data is recorded as the minimum height at which 20 consecutive drops will not cause any explosions.

TABLE III

| Composition | Card Gap Test (JANAF Test #1) ambient temp cards | Impact Test 2 Kg weight (20 drops) mm. |
|---|---|---|
| HAP + glycerin + 10% $H_2O$ | 3.5 | 168 |
| HAP + glycerin + 15% $H_2O$ | 0 | 210 |
| HAP + glycerin + 20% $H_2O$ | 0 | >1000 |
| HAP + glycerin + 25% $H_2O$ | 0 | — |

The liquid monopropellants of this invention do not burn under ambient pressure. Results from strand burning tests show that sustained burning is achieved at pressures in the range of 500 to 2000 psi. Examples are shown in Table IV.

TABLE IV

| Composition | Pressure psi | Burning Rate (inches/sec.) |
|---|---|---|
| 66.92% HAP | 500 | 0.678 |
| 23.08% Glycerin | 1000 | 1.258 |
| 10.00% $H_2O$ | 1500 | 2.155 |
| | 2000 | 3.155 |
| | 2500 | 3.759 |
| | 3000 | 5.263 |
| 63.20% HAP | 1000 | 0.475 |
| 21.80% Glycerin | 2000 | 0.435 |
| 15.00% $H_2O$ | 2500 | 1.698 |
| | 3000 | 2.358 |
| 59.48% HAP | 1000 | no burning |
| 20.52% Glycerin | 2000 | 0.458 |
| 20.00% $H_2O$ | 3000 | 2.632 |
| 65.58% HAP | 1000 | partial burning |
| 14.42% Diethylene glycol | 2000 | 0.448 |
| dimethyl ether | 3000 | 3.077 |
| 20.00% $H_2O$ | | |
| 62.85% HAP | 1000 | no burning |
| 12.15% Diethylene glycol | 2000 | partial burning |
| dimethyl ether | 3000 | 0.799 |
| 25.00% $H_2O$ | | |
| 60.35% HAP | 1000 | no burning |
| 19.65% Ethylene glycol | 2000 | 0.592 |
| 20.00% $H_2O$ | 3000 | 2.475 |
| 56.58% HAP | 1000 | no burning |
| 13.42% Ethylene glycol | 2000 | partial burning |
| 25% $H_2O$ | 3000 | 1.214 |
| 65.00% HAP | 1000 | no burning |
| 15.00% Dioxane | 2000 | 0.530 |
| 20.00% $H_2O$ | 3000 | 0.837 |
| 60.92% HAP | | |
| 14.08% Dioxane | 2000 | no burning |
| 25.00% $H_2O$ | 3000 | partial burning |

The degree of wake caused by the exhaust gases can be determined by calculating the wake parameter, which is defined as the volume of insoluble gas per foot traveled by the torpedo. The values given in Table V are calculated on the basis of $CO_2$ as the insoluble gas. Propellants with wake parameters of less than 0.013 are considered "wakeless" if the torpedo is running at a depth of approximately 50 feet. In general, the wake parameter of the stoichiometric balance of fuel and oxidant and gets progressively larger as the ratio is varied to an unbalanced condition.

TABLE V

| Composition | Wake Parameter |
|---|---|
| Solid grain torpedo propellants | 0.107 |
| 59.48% HAP + 20.52% Glycerin + 20% $H_2O$ | 0.0097 |
| 55.76% HAP + 19.24% Glycerin + 25% $H_2O$ | 0.0093 |
| Power: 90 Shp, speed 45 knots | |

Many modifications of the present invention may be made without departing from the spirit or scope thereof. For example, rather than mix all of the required water initially with the fuel and oxidant, a portion of the required water may be sprayed into the reaction motor chamber during combustion in which instance the water would have the same desensitizing and flame temperature controlling influence.

What is claimed as new and desired to be secured by Letters Patent of the United States is:

1. A liquid monopropellant composition comprising the solution of an hydroxylammonium perchlorate oxidizer, a compatible fuel selected from the group consisting of a water soluble fuel and a water dispersible fuel, and water, wherein said oxidizer, fuel and water are present in the weight ratio of 1:9:10 to 16:1:2.

2. The liquid monopropellant of claim 1 wherein said fuel is selected from the group consisting of the water soluble ethers, nitriles and hydrolyzed polyvinyl acetate, polyhydric alcohols, monohydric alcohols, amides, sulfoxides, sulfones, amines, ketones and sugars.

3. The liquid monopropellant of claim 2 wherein the fuel is a water dispersible fuel containing a minor portion of a suitable surfactant.

4. The liquid monopropellant of claim 1 wherein said fuel is present in an amount sufficient to provide a wake parameter of less than 0.013 and wherein said water is present in an amount of about 5% to about 100% based on the combined weight of fuel and oxidant.

5. The liquid monopropellant of claim 4 wherein said oxidant is present in an amount of from 5% to about 80% by weight of the total composition and said fuel is present in an amount of from about 10% to about 20% based on the weight of the total composition.

6. The liquid monopropellant of claim 4 wherein said oxidizer and fuel are present in a stoichiometric amount calculated to yield essentially a water, carbon dioxide, hydrogen chloride and nitrogen exhaust.

7. The liquid monopropellant of claim 7 wherein said fuel is glycerin.

8. The liquid monopropellant of claim 5 wherein said fuel is dioxane.

9. The liquid monopropellant of claim 5 wherein said fuel is ethylene glycol.

* * * * *